US009883981B1

(12) United States Patent
Lu

(10) Patent No.: US 9,883,981 B1
(45) Date of Patent: Feb. 6, 2018

(54) CREMAINS CONTAINER HAVING BURIED IMAGE

(71) Applicant: Tsung-Hua Lu, Kaohsiung (TW)

(72) Inventor: Tsung-Hua Lu, Kaohsiung (TW)

( * ) Notice: Subject to any disclaimer, the term of this patent is extended or adjusted under 35 U.S.C. 154(b) by 0 days.

(21) Appl. No.: 15/673,508

(22) Filed: Aug. 10, 2017

(51) Int. Cl.
*A61G 17/08* (2006.01)

(52) U.S. Cl.
CPC ..... *A61G 17/08* (2013.01)

(58) Field of Classification Search
CPC ..... A61G 17/08; E04H 13/008; B65D 25/54; G09F 19/02
USPC ..... 27/1; 40/124.5, 409; 220/376, 377, 602, 220/662, 665; 428/13, 14
See application file for complete search history.

(56) References Cited

U.S. PATENT DOCUMENTS 3,992,811 A * 11/1976 Yellin ..... A01G 9/02 206/423
4,944,969 A * 7/1990 Usui ..... B44C 3/025 40/409
5,896,632 A * 4/1999 Sturino ..... A61G 17/08 27/1
5,950,287 A * 9/1999 Cacciatore ..... A61G 17/08 27/1
7,562,423 B2 * 7/2009 Pryd-Kakuk ..... A61G 17/08 27/1
7,861,385 B1 * 1/2011 Meyer ..... A61G 17/08 27/1
8,046,881 B2 * 11/2011 Johnson ..... A61G 17/08 27/1
8,074,329 B2 * 12/2011 Roberts ..... A61G 17/08 27/1
8,336,174 B1 * 12/2012 Johnson ..... A61G 17/007 27/1
8,341,812 B2 * 1/2013 Kocir ..... A61G 17/08 27/1
8,499,425 B2 * 8/2013 Roberts ..... A61G 17/08 27/1
2009/0020488 A1 * 1/2009 Turkel ..... A61G 17/08 211/85.27

* cited by examiner

*Primary Examiner* — William L Miller
(74) *Attorney, Agent, or Firm* — Alan D. Kamrath; Kamrath IP Lawfirm, P.A.

(57) ABSTRACT

A cremains container includes a container body (10), a cover (20) mounted on the container body, and a determined amount of filling powder (30) provided in the container body and the cover. The container body is made of transparent material. The container body has an interior formed with a receiving space (12) and has a periphery provided with a hollow portion (111) receiving the filling powder. The cover is made of transparent material and has an interior provided with a hollow portion (21) receiving the filling powder. Thus, the filling powder in the container body and the cover conceals the receiving space of the container body to prevent the receiving space of the container body from being viewed directly by a person outside of the container body.

5 Claims, 5 Drawing Sheets

CREMAINS CONTAINER HAVING BURIED IMAGE

BACKGROUND OF THE INVENTION

1. Field of the Invention

The present invention relates to a container and, more particularly, to a cremains container.

2. Description of the Related Art

The ancients believed that the souls of the dead will continue to live in another world. In the Chinese world, the dead body was usually buried in the earth to produce a buried image, which means that burial brings peace to the deceased and the live people, and to provide an auspicious effect. A conventional cremains container is only used to store the cremains of the dead body after cremation and cannot provide a buried image, thereby limiting the versatility of the cremains container.

BRIEF SUMMARY OF THE INVENTION

The primary objective of the present invention is to provide a cremains container having a buried image.

In accordance with the present invention, there is provided a cremains container comprising a container body, a cover mounted on the container body, and a determined amount of filling powder provided in the container body and the cover. The container body is made of transparent material. The container body has an interior formed with a receiving space for receiving cremains. The container body has a periphery provided with a hollow portion receiving the filling powder. The cover is made of transparent material. The cover has an interior provided with a hollow portion receiving the filling powder. Thus, the filling powder in the container body and the cover conceals the receiving space of the container body to prevent the receiving space of the container body and the cremains from being viewed directly by a person outside of the container body.

According to the primary advantage of the present invention, the people outside of the cremains container only see the filling powder in the container body and the cover and cannot see the cremains in the receiving space of the container body, so that it looks like the cremains are buried in the earth, to produce a buried image, which means that burial brings peace to the deceased and the live, and to provide an auspicious effect.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
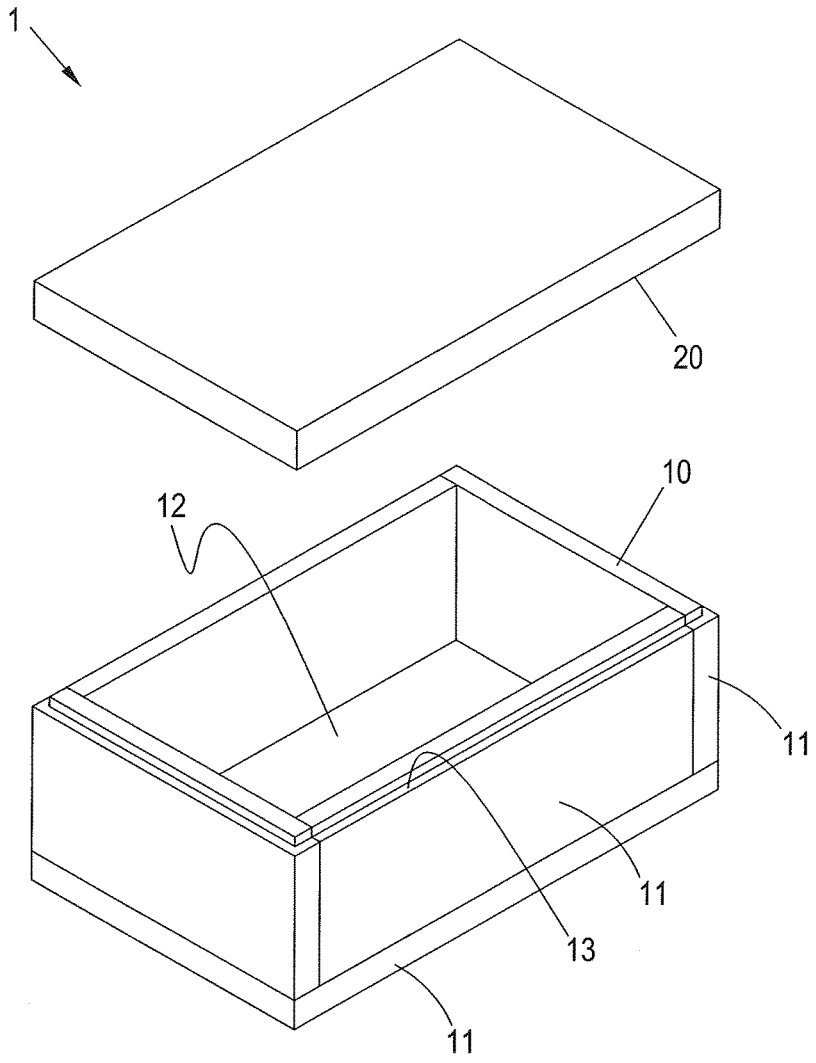
FIG. 1 is an exploded perspective view of a cremains container in accordance with the preferred embodiment of the present invention.
Figure 2:
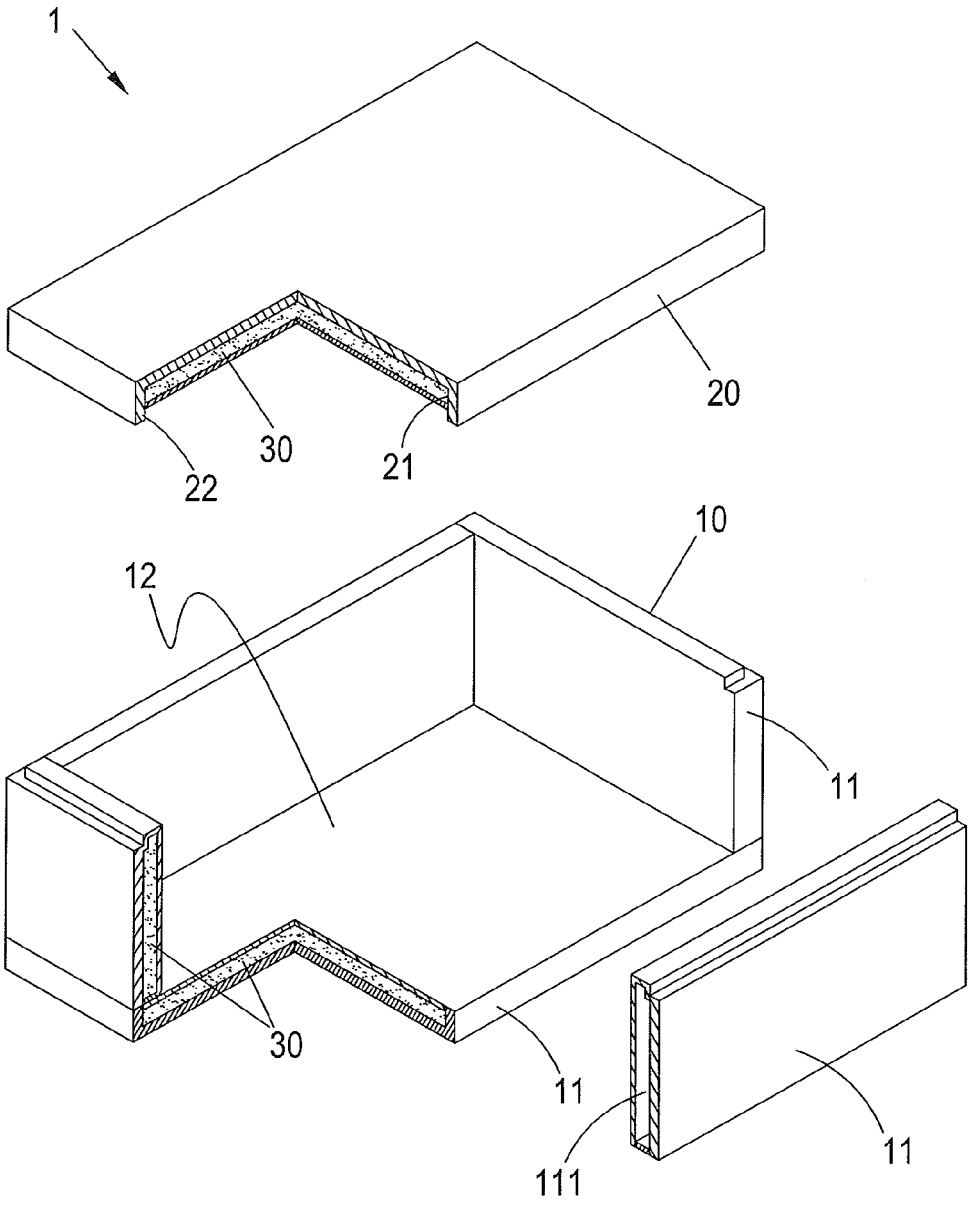
FIG. 2 is a partially exploded perspective cross-sectional view of the cremains container in accordance with the preferred embodiment of the present invention.
Figure 3:
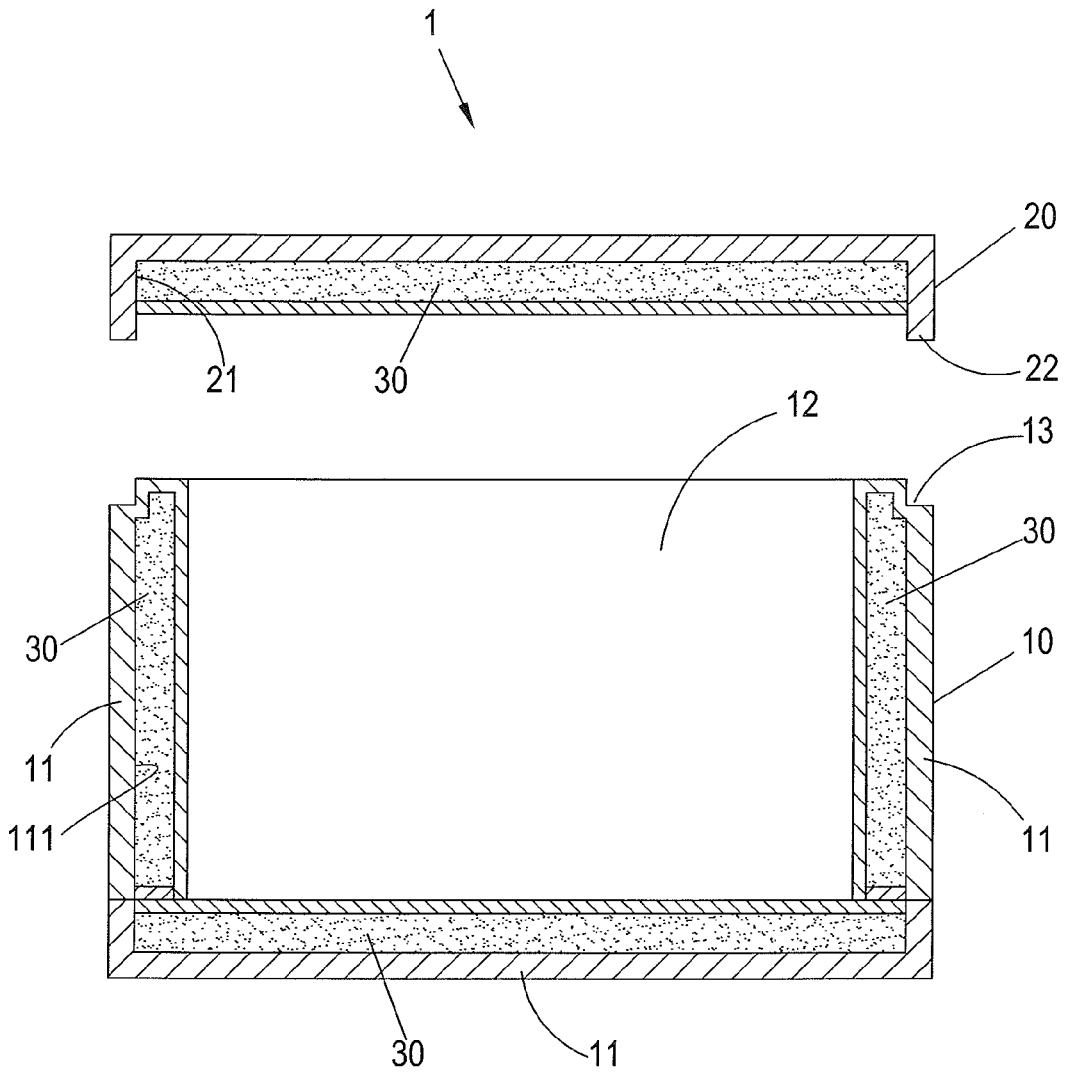
FIG. 3 is a front cross-sectional view of the cremains container as shown in FIG. 1.

Referring to the drawings and initially to FIGS. 1-3, a cremains container 1 in accordance with the preferred embodiment of the present invention comprises a container body 10, a cover 20 mounted on the container body 10, and a determined amount of filling powder 30 provided in the container body 10 and the cover 20. The container body 10 is made of transparent material. The container body 10 has an interior formed with a receiving space 12 for receiving cremains. The container body 10 has a periphery provided with a hollow portion 111 receiving the filling powder 30. The cover 20 is made of transparent material. The cover 20 has an interior provided with a hollow portion 21 receiving the filling powder 30. Thus, the filling powder 30 in the container body 10 and the cover 20 conceals the receiving space 12 of the container body 10 to prevent the cremains in the receiving space 12 of the container body 10 from being viewed directly by a person outside of the container body 10, so that the person outside of the container body 10 only sees the filling powder 30 and cannot see the cremains in the receiving space 12 of the container body 10.

In practice, the people outside of the cremains container 1 only see the filling powder 30 in the container body 10 and the cover 20 and cannot see the cremains in the receiving space 12 of the container body 10, so that it looks like the cremains are buried in the earth, to produce a buried image, which means that burial brings peace to the deceased, and to provide an auspicious effect.

In the preferred embodiment of the present invention, the container body 10 includes a plurality of walls 11 combined together, and the receiving space 12 of the container body 10 is defined by the walls 11. The hollow portion 111 of the container body 10 is formed in each of the walls 11 of the container body 10.

In the preferred embodiment of the present invention, the filling powder 30 is made of soil, sand or mineral.

In the preferred embodiment of the present invention, the container body 10 has an open upper end provided with a mounting seat 13, and the cover 20 has a periphery provided with a cover rim 22 mounted on the mounting seat 13 of the container body 10. Thus, the cover 20 is mounted on the container body 10 to cover the receiving space 12 of the container body 10.

In the preferred embodiment of the present invention, the container body 10 has a surface provided with patterns, figures or characters by a laser sculpture technology to enhance the aesthetic quality of the container body 10.

In the preferred embodiment of the present invention, the filling powder 30 is mixed with a crystal, agate or jade to enhance the value of the cremains container 1.

In the preferred embodiment of the present invention, the container body 10 is made of hard material, such as a crystal or glass.

Figure 4:
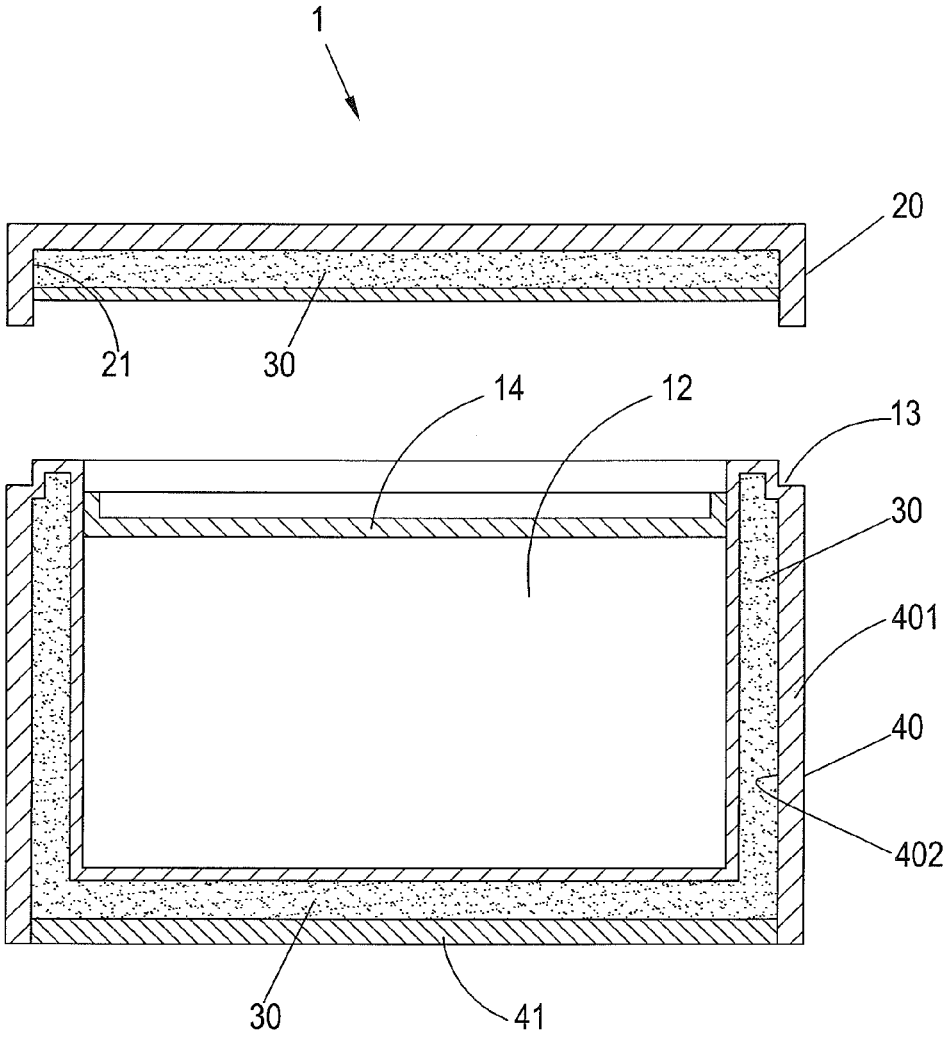
FIG. 4 is a front exploded cross-sectional view of a cremains container in accordance with another preferred embodiment of the present invention.

Referring to FIG. 4, the container body 40 is formed integrally with an enclosing wall 401 with inner and outer interlinings, and the receiving space 12 of the container body 10 is defined by the enclosing wall 401. The hollow portion 402 of the container body 10 is formed in the enclosing wall

401 of the container body 10. The container body 40 has an open bottom, and a seal cap 41 is mounted in the open bottom of the container body 40. The receiving space 12 of the container body 10 has an open end provided with an inner cap 14 to protect the cremains in the receiving space 12 of the container body 10.

Figure 5:
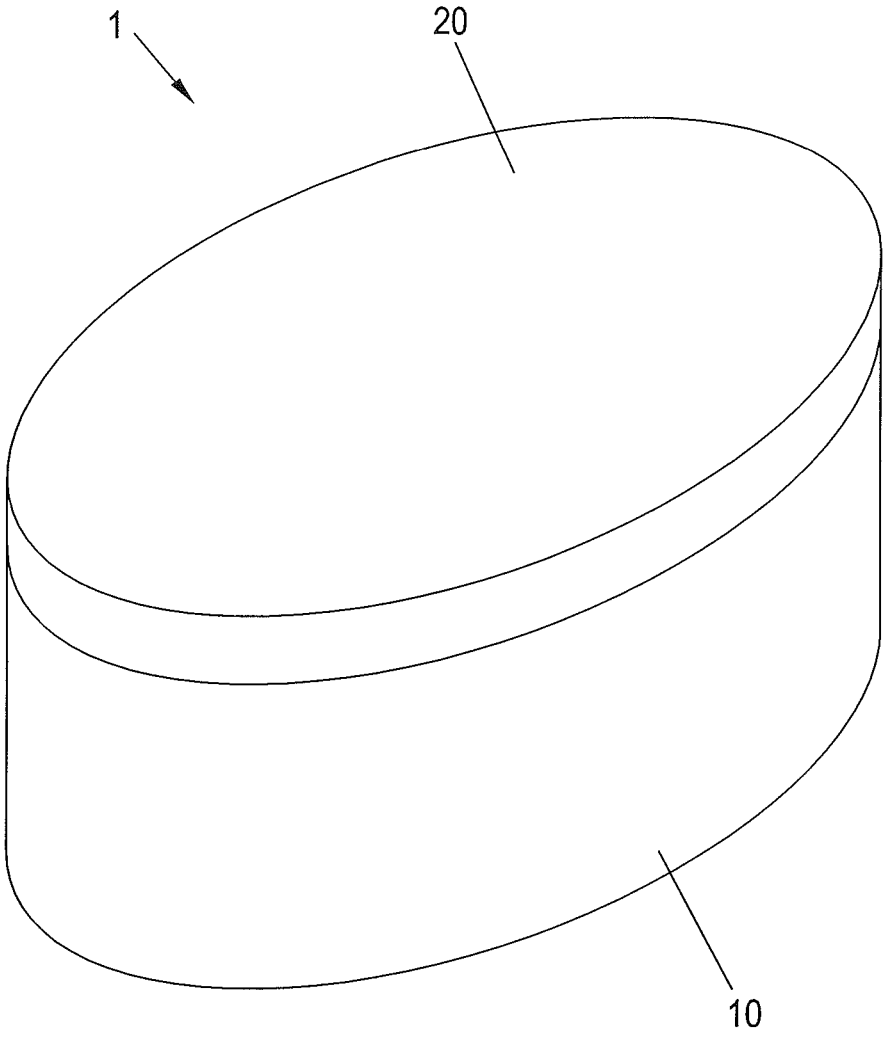
FIG. 5 is a perspective view of a cremains container in accordance with another preferred embodiment of the present invention.

Referring to FIG. 5, the cremains container 1 has an oblong shape. Alternatively, the cremains container 1 has a rectangular, circular or polygonal shape.

Accordingly, the people outside of the cremains container 1 only see the filling powder 30 in the container body 10 and the cover 20 and cannot see the cremains in the receiving space 12 of the container body 10, so that it looks like the cremains are buried in the earth, to produce a buried image, which means that burial brings peace to the deceased and the live, and to provide an auspicious effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A cremains container comprising:

a container body (10);

a cover (20) mounted on the container body; and a determined amount of filling powder (30) provided in the container body and the cover;

wherein:

the container body is made of transparent material;

the container body has an interior formed with a receiving space (12) for receiving cremains;

the container body has a periphery provided with a hollow portion (111) receiving the filling powder;

the cover is made of transparent material;

the cover has an interior provided with a hollow portion (21) receiving the filling powder; and the filling powder in the container body and the cover conceals the receiving space of the container body to prevent the receiving space of the container body and the cremains from being viewed directly by a person outside of the container body.

2. The cremains container of claim 1, wherein:

the container body includes a plurality of walls (11) combined together;

the receiving space of the container body is defined by the walls; and the hollow portion of the container body is formed in each of the walls of the container body.

3. The cremains container of claim 1, wherein:

the container body (40) is formed integrally with an enclosing wall (401) with inner and outer interlinings;

the receiving space of the container body is defined by the enclosing wall;

the hollow portion (402) of the container body is formed in the enclosing wall of the container body;

the container body has an open bottom; and a seal cap (41) is mounted in the open bottom of the container body.

4. The cremains container of claim 1, wherein the filling powder is made of soil, sand or mineral.

5. The cremains container of claim 1, wherein the receiving space of the container body has an open end provided with an inner cap (14).

* * * * *